US006624800B2

(12) United States Patent
Hughes et al.

(10) Patent No.: US 6,624,800 B2
(45) Date of Patent: Sep. 23, 2003

(54) CONTROLLER CIRCUIT FOR LIQUID CRYSTAL MATRIX DISPLAY DEVICES

(75) Inventors: John R. Hughes, Horley (GB); David W. Parker, Redhill (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 178 days.

(21) Appl. No.: 09/814,387

(22) Filed: Mar. 21, 2001

(65) Prior Publication Data

US 2001/0024199 A1 Sep. 27, 2001

(30) Foreign Application Priority Data

Mar. 22, 2000 (GB) ..... 0006811

(51) Int. Cl.[7] ..... G09G 3/36
(52) U.S. Cl. ..... 345/88
(58) Field of Search ..... 345/87, 92, 58, 345/94, 100, 89, 88, 63; 348/760, 761; 349/33, 41, 42

(56) References Cited

U.S. PATENT DOCUMENTS 5,130,829 A 7/1992 Shannon ..... 359/59
5,495,265 A 2/1996 Hartman et al. ..... 345/87
5,841,411 A * 11/1998 Francis ..... 345/58
5,978,023 A * 11/1999 Glenn ..... 348/234
6,411,341 B1 * 6/2002 De Haan et al. ..... 348/714
6,414,664 B1 * 7/2002 Conover et al. ..... 345/89

FOREIGN PATENT DOCUMENTS

WO WO9905567 W 2/1999 ..... G02F/1/343

* cited by examiner

*Primary Examiner*—Chanh Nguyen

(57) ABSTRACT

A controller circuit (24) for processing video data for an active matrix liquid crystal display device has processing circuitry for performing correction functions on the input video data (D) prior to being supplied to the drive circuit (22) of the display device comprising gamma and color correction, and correction for reducing motion blur in the display picture. The correction circuits (35, 36) are organized such that correction for motion blur reduction (36) is carried out before the gamma and color corrections (35), which enables a beneficial decrease in semiconductor area required when implementing the circuitry in IC form through the size of field store (30) and LUT (32) components used for this function then being smaller. Gamma and color corrections are performed together using a single LUT. Correction for kickback may further be included, such correction preferably being arranged after the gamma and color corrections and using a separate LUT.

20 Claims, 3 Drawing Sheets

CONTROLLER CIRCUIT FOR LIQUID CRYSTAL MATRIX DISPLAY DEVICES

This invention relates to a controller circuit, preferably in the form of a semiconductor integrated circuit (IC), for processing video data for liquid crystal matrix display devices, the circuit having an input to which video data is applied and an output from which processed video data is supplied for the pixels of the display device.

In a typical active matrix liquid crystal display device, (AMLCD), a video signal, for example from a computer or other source, is supplied to video signal processing and control circuitry which outputs processed video signals and timing signals to row (selection) and column (source) driver circuits associated with the pixel array of the display panel and which are responsible for sampling the data of the video signal and applying the samples, in the form of data voltage signals, to the appropriate pixels of the array on a row by row basis. The row and column driver circuits, which usually comprise a shift register circuits with the latter also including a sample and hold circuit, can be provided in the form of ICs mounted on the LC display panel or possibly, if the nature of the technology used in the pixel array permits, as in the case for example of polysilicon TFT devices being used as pixel switches, fully integrated on the panel and fabricated simultaneously with the pixel array using the same thin film electronics technology.

An example of the above-described kind of active matrix liquid crystal display device and its general manner of operation is described in U.S. Pat. No. 5,130,829 to which reference is invited for further information.

Normally the video signal processing and the timing and control circuitry is implemented in the form of one or more silicon integrated circuits (ICs) with the processing being performed digitally.

The signal processing functions performed on the applied video signal by the video signal processing and control circuitry can be various.

The present invention is concerned particularly, although not exclusively, with video signal processing for avoiding or reducing unwanted artefacts in the displayed picture due to behavioural effects of the pixels and also for gamma correction and colour temperature correction.

For gamma, colour and kickback corrections, then Look Up Tables (LUTs) can be used to provide correctional values. For the latter correction, data signal sign information usually also would be required. In AMLCDs, the data voltage signals applied to the pixels have to be periodically inverted to prevent any net DC voltage across the LC material, the inversion being for example for every successive frame (so-called field inversion) or, in addition, for every successive row of pixels (so-called line or row inversion), for adjacent columns of pixels (so-called column inversion) or such that adjacent pixels in both the row and column direction are of opposite polarity (so-called pixel inversion), according to the particular inversion drive scheme employed.

In order to reduce the extent of perceived blurring in the display picture when displaying moving images, which results from the inherent behaviour of the pixels, and particularly the slow response characteristics of the LC material to pixel voltage changes, then preferably the video data processing includes correction for achieving motion blur reduction, a preferred example of such being described in U.S. Pat. No. 5,495,265 (PHN 13505), which requires for this purpose data signal information from one field to the next, and thus a field store for storing at least the data signal values for one field, as well as a LUT.

It is an object of the present invention to provide for use with a matrix display device an improved controller circuit for performing certain video signal processing operations.

It is another object of the present invention to provide a matrix display device controller circuit for performing certain video signal processing functions which can be produced as an IC at lower cost.

According to the present invention, there is provided a controller circuit for processing video data for a colour active matrix liquid crystal display device and having an input for video data processing circuitry for processing the video data and an output from which the processed video data is provided for supply to a driver circuit of the display device, wherein the processing circuitry comprises gamma and colour correction circuits which include a Look-Up Table, and a motion blur reduction circuit for modifying the video data so as to reduce perceived blurring in moving images displayed on the display device and comprising a field store for video data and a Look-Up Table, and wherein the motion blur reduction circuit precedes the gamma and colour correction circuits.

The invention provides a controller circuit for use in the driving of an active matrix LC display device and implementable in IC form which performs certain video signal processing functions to improve the quality of the picture produced by the display device and in which the circuits for performing the video signal processing functions are arranged and organised in the circuit in a manner which makes more efficient use of the semiconductor material whereby the area of semiconductor material required, and hence cost of the IC, is reduced.

The video signal processing functions performed comprise gamma correction, colour correction (to achieve white of a desired colour temperature), and motion blur reduction (to reduce blurring caused by the behaviour of the pixel, particularly the slow response to the LC material to pixel voltage change,) when displaying moving images. Preferably, the controller circuit further includes a kickback correction circuit which also follows the motion blur reduction circuit.

Having regard to the nature of these different corrections, it would be thought in principle appropriate for the gamma and colour corrections, and the kickback correction if present, to be carried out first and the motion blur correction to be carried out last as the former corrections are made to the video data in order to get the correct voltages on the pixels in the static case and the motion blur reduction is then supposed to ensure that those same voltages appear on the pixels despite the temporal response behaviour of the pixel. However, the motion blur reduction processing of the video data signals is, in accordance with the invention, arranged instead to be carried out before the gamma, colour and optional kickback corrections. This leads to less complexity and allows the field store required for the motion blur reduction to be narrower, (fewer bits for each data value) than is the case when motion blur reduction processing is performed last, which arrangement necessitates separate correction of the positive and negative drive ranges. Moreover, the size of the associated LUT will be smaller. Substantial benefits are then obtained when the circuitry is translated into IC form, particularly in terms of the area of silicon required.

The gamma, colour and optional kickback corrections could all be performed using a single, suitably programmed, Look Up Table (LUT).

However, in a preferred embodiment incorporating kickback correction the gamma and colour corrections are performed together, using a single LUT, after the motion blur reduction processing, and the kickback correction is performed lastly. With this arrangement the size of the necessary LUT for gamma and colour correction can be considerably reduced as the need to take into account the sign of the data signal (the data signal voltages applied to the pixels periodically being inverted according to particular drive scheme employed) is required only for the kickback correction (because this is drive polarity dependent) and gamma and colour corrections can be made on the "unsigned" data value. Although a LUT is still needed for kickback correction this is smaller than the reduction in size enabled for the LUT associated with the gamma and colour combined so that, overall, the combined sizes of the LUTs is reduced.

This size reduction results in further beneficial reduction in the semiconductor area (i.e. silicon) needed for the IC, and consequently a lower cost IC.

Embodiments of active matrix LC display devices and controller circuits used therewith according to the present invention will now be described, by way of example, with reference to the accompanying drawings, in which.

The same reference numbers or signs are used throughout the figures to denote the same parts or signals.

Figure 1:
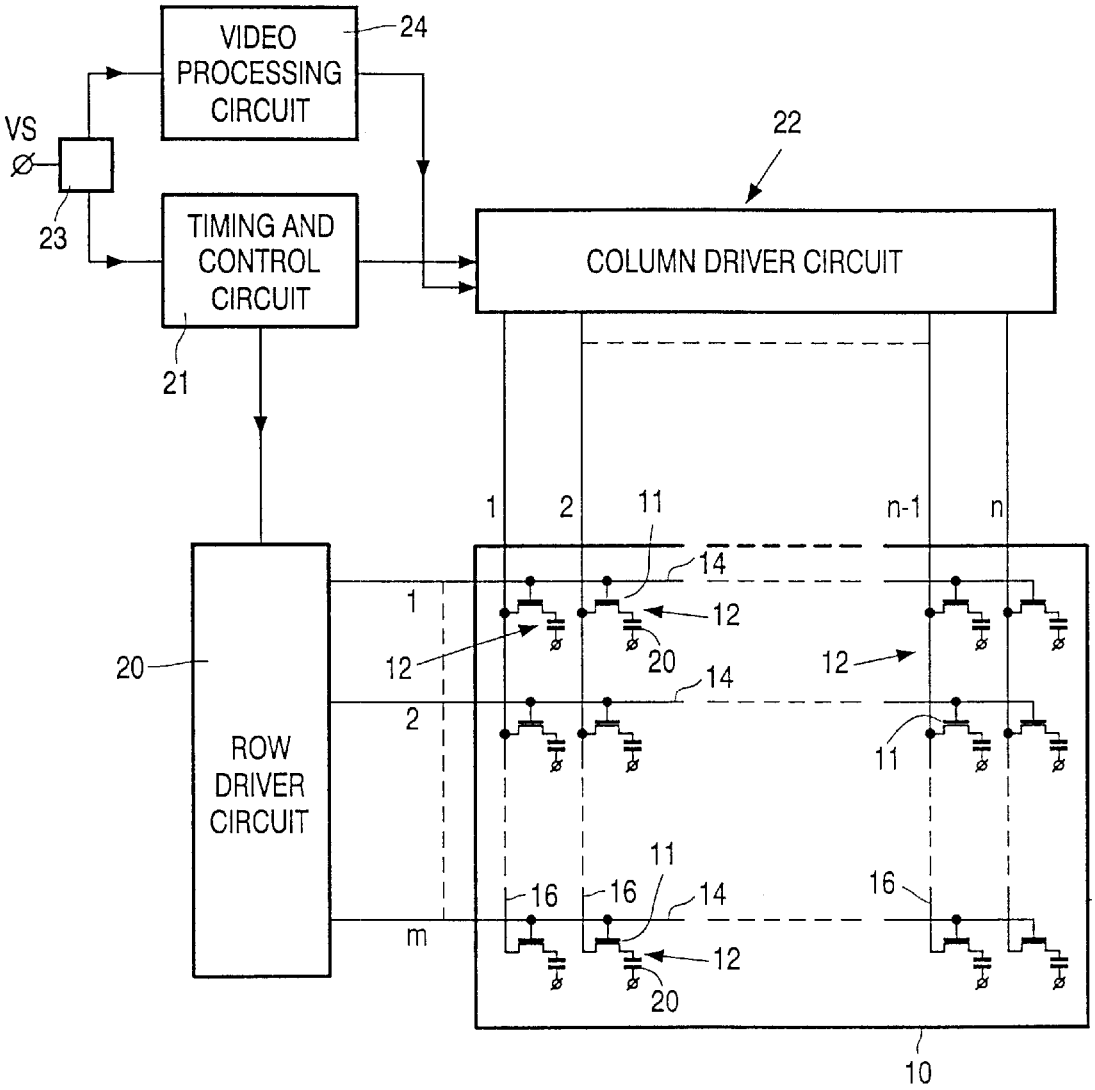
FIG. 1 is a schematic circuit diagram of an active matrix LC display device.

Referring to FIG. 1, the active matrix LC display device shown is of generally convention form, for example as described in U.S. Pat. No. 5,130,829 to which reference is invited for further details as to its construction and general manner of operation, and whose contents in these respects are incorporated herein by reference. Briefly, the display device, which is suitable for displaying colour video pictures, comprises a liquid crystal display panel 10 having a row and column array of pixels 12 which consists of m rows (1 to m) with n horizontally arranged pixels (1 to n) in each row. Only a few of the pixels are shown for simplicity.

Each pixel 12 is associated with a respective switching device in the form of a thin film transistor, TFT, 11. The gate terminals of all TFTs 11 associated with pixels in the same row are connected to a common row conductor 14 to which, in operation, selection (gating) signals are supplied. Likewise, the source terminals associated with all picture elements in the same column are connected to a common column conductor 16 to which data (video) signals are applied. The drain terminals of the TFTs are each connected to a respective transparent pixel electrode 20 forming part of, and defining, the pixel's display element. The conductors 14 and 16, TFTs 11 and electrodes 20 are carried on one transparent plate while a second, spaced, transparent plate carries an electrode common to all pixels. Liquid crystal material is disposed between the plates.

The display panel is operated in conventional manner. Light from a light source disposed on one side enters the panel and is modulated according to the individual transmission characteristics of the pixels 12. The device is driven on a row at a time basis by scanning the row conductors 14 sequentially with a gating (selection) signal so as to turn on each row of TFTs in turn and applying data (video) signals to the column conductors for each row of pixels in turn as appropriate and in synchronism with the gating signals so as to build up a complete display picture in one field. Using one row at time addressing, all TFTs 11 of the addressed row are switched on for a period determined by the duration of the gating signal, corresponding to a video line time or less, during which the video information signals are transferred from the column conductors 16 to the pixels 12. Upon termination of the gating signal, the TFTs 11 of the row are turned off for the remainder of the field time thereby isolating the pixels from the conductors 16 and ensuring the applied charge is stored on the pixels until the next time they are addressed, usually in the next field period.

All the pixels are addressed in a respective field (i.e frame) period and are repeatedly addressed in successive field periods in accordance with the video data signal information of successive fields of an applied video signal.

The row conductors 14 are supplied successively with gating signals by a row driver circuit 20 comprising a digital shift register controlled by regular timing pulses from a timing and control circuit 21. In the intervals between gating signals, the row conductors 14 are supplied with a substantially constant reference potential by the drive circuit 20. Video data signals are supplied to the column conductors 16 from a column (source) driver circuit 22, comprising one or more shift register/sample and hold circuits. The circuit 22 is supplied with video data signals from an output of a controller IC 24 comprising a digital video data signal processing circuit and timing pulses from the circuit 21 in synchronism with row scanning to provide serial to parallel conversion appropriate to the row at a time addressing of the panel 10. The circuits 20 and 22 used here are of conventional kind. According to known practice, a graphics standard converter may be arranged between the circuits 23 and 24, for converting an applied video signal to a required standard appropriate to the display device, for example from XGA to SXGA.

The timing and control circuit 21 is supplied with timing signals extracted from an applied digital video signal VS by means of a separation circuit 23 while the data signals, in digital form, from the video signal are supplied by the separation circuit to an input of the video data signal processing circuit 24.

In accordance with standard practice, the sign (polarity) of the data signal voltage applied to the pixel is periodically inverted with respect to the common electrode, at least for every successive field, and possibly also in accordance with a line, column, or pixel inversion drive scheme if employed.

Depending on the technology used to fabricate the pixel array, the row and column drive circuits 20 and 22 may be provided in the form of semiconductor (silicon) ICs mounted on one substrate of the panel and connected directly with the row and column conductors or, in the case for example of the TFTs comprising polysilicon rather than amorphous silicon TFTs, fully integrated with the pixel array and similarly comprising polysilicon TFT circuitry on the substrate fabricated simultaneously with the pixel array.

The input video signal VS, for example from a PC or other video source, comprises 8 bit digital colour (R, G and B) data signals and synchronisation signals. The controller IC 24 modifies digitally the R, G and B signals, as will be described, and the modified digital data signals output from the controller IC are subsequently converted to analogue voltage signals useable by the pixels before being supplied to the pixels. To this end, a D/A converter circuit may be incorporated in the column driver circuit 22 or connected between the controller IC 24 and that circuit.

The data signal processing functions performed by the circuit 24 comprise gamma and colour correction, kickback correction and motion blur reduction.

With regard to the colour and gamma correction, then to achieve a good colorimetric performance from the LC display the transfer characteristic (i.e. brightness versus drive) is usually transformed to be similar to that of a CRT. That is, the luminance is varied with data input signal value according to a power function with a typical gamma of 2.2. The relative gains of the R, G and B signals are modified so as to achieve a white of the desired colour temperature. Also the relative R, G and B transfer characteristics are modified to correct for the change of colour point with drive level that is typical of an LCD. All the above are achieved by using LUTs to modify the R, G and B data signal values to be supplied to the pixels. Suitable circuits for gamma and colour correction will be known to skilled persons and as such it is considered unnecessary to describe examples here in detail.

Motion blur reduction involves processing to reduce unwanted display effects which can result when moving images are displayed. When displaying a moving image on a conventional AMLCD the image becomes blurred and a particular reason for this is the slow response of the LC material of a pixel, and hence the transmission through the device, to a change in applied pixel voltage. It is known that the blurring effect can be reduced by overdriving temporal transitions in the R, G and B signals such that the desired transmission can be achieved within a single field (frame) period. The data required for deciding how much overdrive to use for a given transition can be acquired by appropriate experimentation. Examples of motion blur reduction processing are described in EP-A-5495265 and WO99/05567 to which reference is invited, and whose contents are incorporated herein as reference material.

Figure 2:
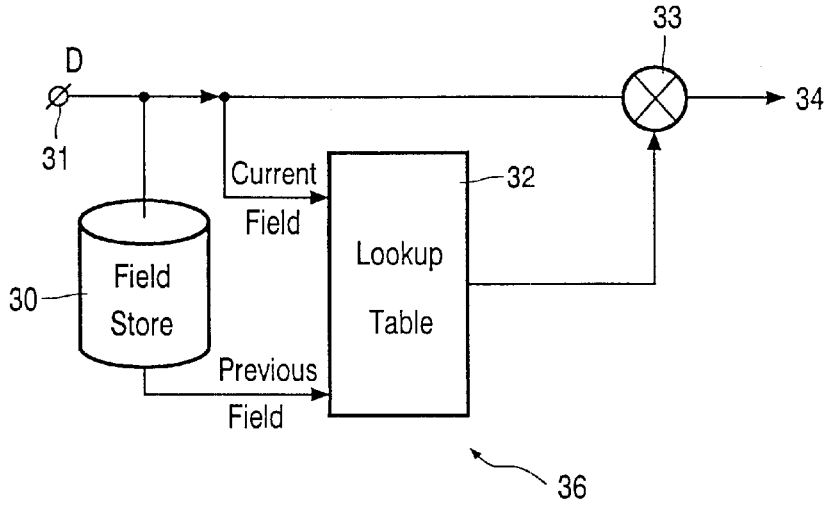
FIG. 2 illustrates schematically a motion blur reduction circuit.

FIG. 2 shows schematically the operation of such blur reduction signal processing. A field store 30 is required to enable evaluation of the pixel voltage transition from the previous to the current field. The data signals, D, for a current field fed to an input 31 are supplied to an LUT 32 and also to the field store 30 and the data signals for the previous field are at the same time output from the field store to the LUT 32. Thus an indication of the voltage transitions of the individual pixels is available. The LUT is appropriately preprogrammed and the amount of overdrive to be used for a given transition stored in the LUT is used to modify the data signals through an adder circuit 33 with the suitably modified data signals being output at 34. Successive fields of data signals are fed serially to the input and successive fields with appropriately modified data signals are supplied at the output.

Kickback correction is intended to overcome the phenomenon, known as kickback, due to the trailing edge of a row selection (gating) pulse applied to the row conductors 14 feeding through the TFT gate to drain capacitance, Cgd, and affecting the voltage set on a pixel. The size of this effect, that is, the voltage error caused, is dependent on the relative magnitudes of Cgd and the pixel capacitance. (The pixel capacitance will consist of the LC (display element) capacitance and also any fixed storage capacitor connected in parallel although the latter is not shown in FIG. 1).

The LC capacitance varies according to the applied pixel voltage and so the magnitude of the kickback voltage depends on the voltage of the pixel. The kickback also depends on the polarity of the pixel voltage. The TFT 11 remains conducting for a greater part of the gate selection voltage drop during the negative cycle than during the positive cycle. As a result, there is more TFT channel charge contributing to the kickback during the negative than the positive cycle. If the same DC voltage correction is applied in both cycles, then because the kickback in the negative cycle is greater, the magnitude of the final pixel voltage of both cycles will be greater than the magnitude of the applied source voltage. This can be taken into account when considering the transfer characteristic.

It is conventional to compensate for the "average" value of kickback i.e. that suffered by a mid-grey pixel, by adjusting the common electrode voltage. The remaining error for pixels that are "blacker" or "whiter" than this can be compensated by adjusting the column driver circuit voltage accordingly. This adjustment can be stored in a Look-Up Table whose input is the value of the pixel voltage. For a still picture this is the current field pixel voltage. For a moving picture this should be from the previous field. One important point to note is that although the column driver circuit output data signal alternates in polarity at field rate for any given pixel, the polarity of the kickback effect, and hence that of the kickback correction, is always the same. This has consequences for the signal processing architecture as will be seen below.

Figure 3:
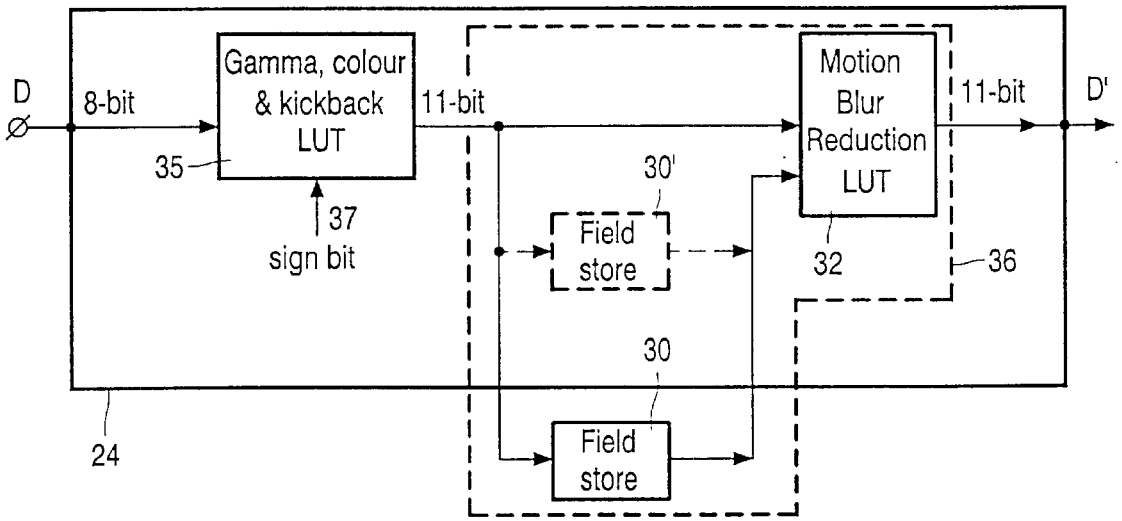
FIG. 3 illustrates schematically an example controller IC comprising video data signal processing circuit incorporating certain signal processing functions.

In principle, it would be expected that the gamma, colour and kickback corrections should be done first and the motion blur correction last. This is because the former corrections are being made to get the correct voltage on the pixel in a static case, and the motion blur reduction is then supposed to be ensuring that that same, corrected, voltage ends up on the pixel despite the temporal response of the display. FIG. 3 is a schematic diagram depicting the ordering of the processing functions in an example controller IC 24 which follows normal expectations in this respect. In this figure, block 35 represents the combined gamma, colour and kickback correction circuitry and the block 36 represents the motion blur reduction processing circuitry, including the field store 30. The field store component 30 here is provided as a separate IC, although it could instead be incorporated in the IC 24, as signified at 30'. The gamma, colour and kickback corrections could be carried out by a single LUT as indicated in FIG. 3. The input to this LUT is the 8-bit data value for one of the (R, G, B) data signals plus a single bit signal, at 37, indicating whether positive or negative polarity drive is to be used for that pixel. This signing signal is generated by logic elsewhere in the controller IC and depends on the particular inversion scheme being used. The output from this circuitry, comprising 11-bit data signals, are supplied to the processing circuitry 36 which, in turn, outputs processed, 11-bit, data signals, denoted at D'.

Figure 4:
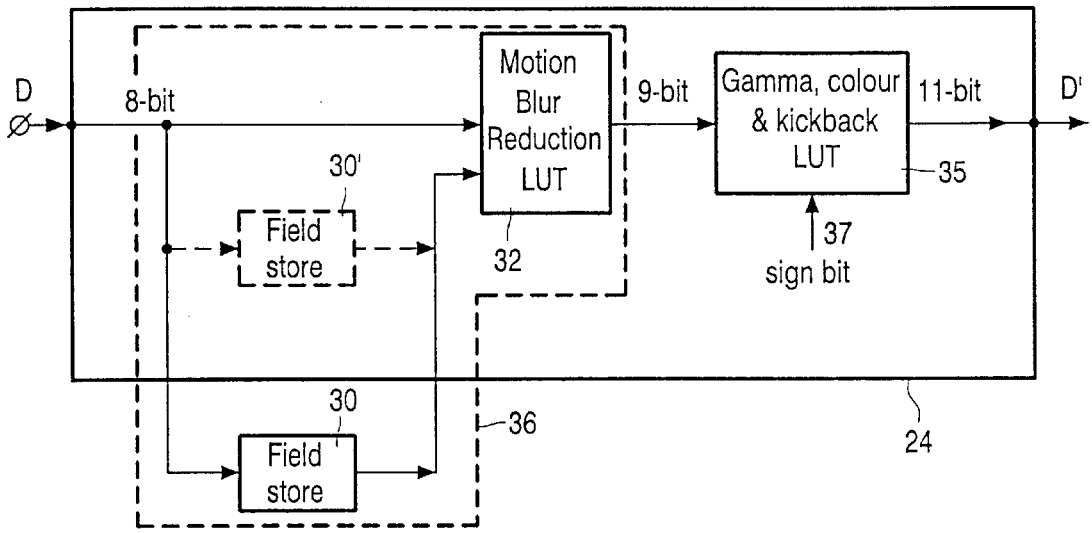
FIGS. 4 and 5 illustrate first and second embodiments of a controller IC incorporating certain signal processing functions in accordance with the present invention and used in the display device of FIG. 1.

FIG. 4 illustrates a first embodiment of a controller IC 24 according to the present invention. The same reference numbers are used to denote the same processing circuitry parts and functions. As can be seen in FIG. 4, then the processing functions are re-ordered such that the motion blur reduction processing is performed first. Again, the field store of the motion blur reduction processing circuit 36 may be provided separately as shown at 30 or within the IC 24, as shown at 30'. The output from the motion blur correction is increased to 9 bits, from 8-bits, for a data signal as it must cover a larger voltage range than just black-to-white to allow for some "overdrive". The motion blur reduction LUT can be modified to take approximate account of the later effects of the colour and gamma correction, so this will not lead to much error. A potential problem comes with the Kickback correction, which cannot be allowed for in the motion blur LUT, as there is no polarity information at that stage. The order of magnitude of the Kickback correction may be ~±0.25 volts so the motion blur reduction calculations will be made on signals which might be ~±0.25 volts different to those that should actually be applied to the pixels. However, in order to minimise the size of the field store, the minimum possible number of bits is used. It has been determined that a useful reduction in motion blur can be achieved by storing only the top 3 bits of the data signal in the field store. In this case, the motion blur correction only affects the top 3 bits of the drive voltage which means that it is accurate only to about 0.5 volts (taking black to white as 4 volts). So for this level of accuracy in motion blur correction, the order of processing indicated in FIG. 4 can be acceptable. For static images, of course, there is no problem.

Figure 5:
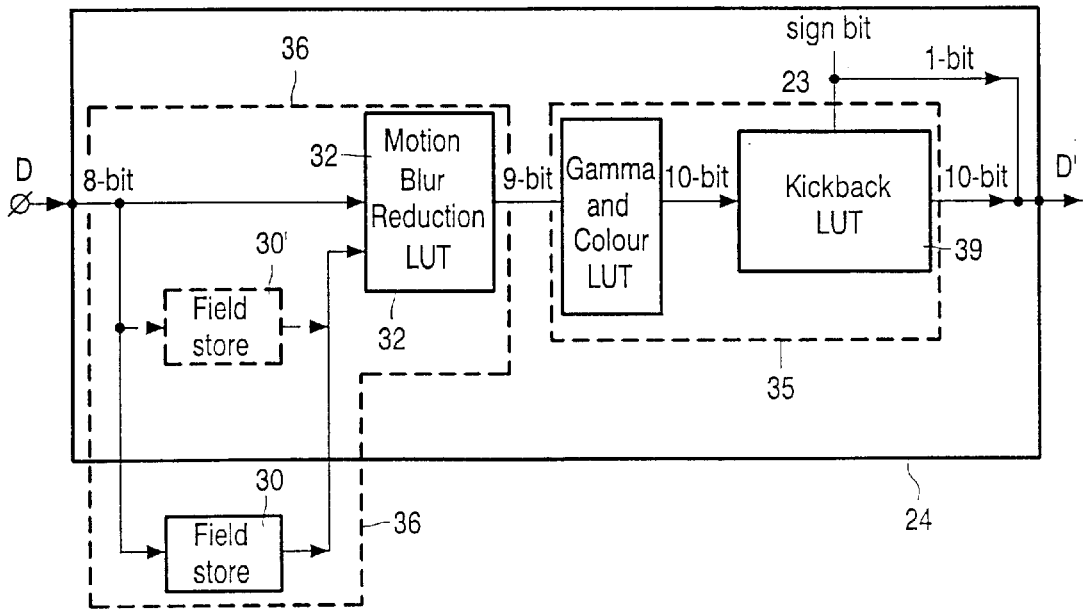

Assuming there are 1024 pixels in a row, the size of the gamma, colour and kickback LUT in FIG. 4 is 1024×11=11 Kbits. This size can be reduced to 512×10=5 Kbits if the colour and gamma corrections are carried out on the unsigned drive signal and kickback correction (which is drive polarity dependent) is added afterwards. This is illustrated in FIG. 5 which is schematic representation of the processing functions in the controller IC 24 in a second embodiment according to the present invention with the kickback correction circuit, here shown at 39, separated from, and following, the gamma and colour correction circuits 35. The size of the additional LUT required by the Kickback correction is very much smaller than 5 Kbits, so a net overall reduction in semiconductor silicon area needed by the IC is achieved. The sign bit is input to the kickback correction to indicate whether the correction is to be added or subtracted.

The architecture of the IC illustrated in FIG. 5 thus enables the IC to be fabricated at lower cost.

In this controller IC the level dependent kickback correction will not be wholly correct for the changing parts of the displayed picture. This is because the kickback voltage depends on the pixel capacitance before the new signal is applied (i.e. the pixel value from the previous field) and the kickback correction in FIG. 5 is being calculated using the current pixel value. It is estimated that in the worse case (a black to white transition) this may lead to an incorrect pixel drive voltage of the order of half a volt. It should be noted that this is quite normal with "conventional" kickback correction schemes also. The effect only applies to the edges of moving objects and will probably be difficult to observe, in normal use of the display device. A further improvement, therefore, would be to use the signal from the field store to evaluate kickback correction for moving parts of the picture.

Although the timing and control circuit 21 is shown separately in FIG. 1, this circuit can be combined with the processing circuit 24 in the same IC.

In summary, therefore, there has been described a controller circuit for processing video data for an active matrix liquid crystal display device which has processing circuitry for performing correction functions on the input video data prior to being supplied to the drive circuit of the display device comprising gamma and colour correction, and correction for reducing motion blur in the display picture. The correction circuits are organised such that correction for motion blur reduction is carried out before the gamma and colour corrections, which enables a beneficial decrease in semiconductor area required when implementing the circuitry in IC form through the size of field store and LUT components used for this function then being smaller. Gamma and colour corrections are performed together using a single LUT. Correction for kickback may further be included, such correction preferably being arranged after the gamma and colour corrections and using a separate LUT.

From reading the present disclosure, other modifications will be apparent to persons skilled in the art. Such modifications may involve other features which are already known in the field of active matrix display devices and controller circuits therefor and which may be used instead of or in addition to features already described herein.

What is claimed is:

1. A controller circuit for processing video data for a colour active matrix liquid crystal display device comprising a plurality of pixels and having an input for video data, processing circuitry for processing the video data and an output from which the processed video data is provided for supply to a driver circuit of the display device, wherein the processing circuitry comprises gamma and colour correction circuits which include a Look-Up Table, and a motion blur reduction circuit for modifying the video data so as to reduce perceived blurring in moving images displayed on the display device caused by a behaviour of said pixels and comprising a field store for video data and a Look-Up Table, and wherein the motion blur reduction circuit precedes the gamma and colour correction circuits.

2. A controller circuit according to claim 1, wherein the controller circuit further includes a kickback correction circuit for modifying the video data so as to correct for kickback effects in the display device pixels and which is arranged following the motion blur reduction circuit.

3. A controller circuit according to claim 2, wherein the kickback correction circuit follows also the gamma and colour correction circuits.

4. An active matrix liquid crystal display system comprising an active matrix liquid crystal display device and a controller circuit according to claim 3, and in which the output of the controller circuit is connected to a drive circuit of the active matrix liquid crystal display device.

5. An active matrix liquid crystal display system comprising an active matrix liquid crystal display device and a controller circuit according to claim 2, and in which the output of the controller circuit is connected to a drive circuit of the active matrix liquid crystal display device.

6. A controller circuit according to claim 1, wherein the controller circuit is in the form of one or more integrated circuits.

7. An active matrix liquid crystal display system comprising an active matrix liquid crystal display device and a controller circuit according to claim 6, and in which the output of the controller circuit is connected to a drive circuit of the active matrix liquid crystal display device.

8. An active matrix liquid crystal display system comprising an active matrix liquid crystal display device and a controller circuit according to claim 1, and in which the output of the controller circuit is connected to a drive circuit of the active matrix liquid crystal display device.

9. An active matrix liquid crystal display system according to claim 8, wherein the controller circuit further includes a kickback correction circuit for modifying the video data so as to correct for kickback effects in the display device pixels and which is arranged following the motion blur reduction circuit.

10. An active matrix liquid crystal display system according to claim 9, wherein the kickback correction circuit follows the gamma and colour correction circuits.

11. An active matrix liquid crystal display system according to claim 8, wherein the controller circuit is in the form of one or more integrated circuits.

12. A method for processing video data in a colour active matrix liquid crystal display device of the type comprising a plurality of pixels and comprising an input for video data, processing circuitry for processing the video data, and an output from which the processed video data is provided to a driver circuit of the display device, said method comprising the steps of:

providing gamma and colour correction for said video data in gamma and colour correction circuits; and modifying the video data in a motion blur reduction circuit so as to reduce perceived blurring in moving images displayed on the display device caused by a behaviour of said pixels;

wherein said step of modifying the video data in said motion blur reduction circuit precedes the step of providing gamma and colour correction for said video data in said gamma and colour correction circuits.

13. A method according to claim 12, further comprising the step of:

modifying the video data in a kickback correction circuit to correct for kickback effects in said display device pixels after said step of modifying the video data in said motion blur reduction circuit.

14. A method according to claim 13, further comprising the step of:

modifying the video data in a kickback correction circuit to correct for kickback effects in said display device pixels after said step of providing gamma and colour correction for said video data in said gamma and colour correction circuits.

15. A method according to claim 14, further comprising the step of:

connecting an output of said controller circuit to a drive circuit of an active matrix liquid crystal display device.

16. A method according to claim 13, further comprising the step of:

connecting an output of said controller circuit to a drive circuit of an active matrix liquid crystal display device.

17. A method according to claim 12, further comprising the step of:

performing in at least one integrated circuit said step of modifying the video data in said motion blur reduction circuit and said step of providing gamma and colour correction for said video data in said gamma and colour correction circuits.

18. A method according to claim 12, further comprising the step of:

connecting an output of said controller circuit to a drive circuit of an active matrix liquid crystal display device.

19. A controller circuit for processing video data for a colour active matrix liquid crystal display device comprising a plurality of pixels and having an input for video data, processing circuitry for processing the video data and an output from which the processed video data is provided for supply to a driver circuit of the display device, wherein the processing circuitry comprises gamma and colour correction circuits which include a Look-Up Table, and a motion blur reduction circuit for modifying the video data so as to reduce perceived blurring in moving images displayed on the display device and comprising a field store for video data and a Look-Up Table, and wherein the motion blur reduction circuit precedes the gamma and colour correction circuits; and wherein the controller circuit further includes a kickback correction circuit for modifying the video data so as to correct for kickback effects in the display device pixels and which is arranged following the motion blur reduction circuit.

20. A controller circuit according to claim 19, wherein the kickback correction circuit follows the gamma and colour correction circuits.

* * * * *